United States Patent [19]

Vann

[11] 4,009,757

[45] Mar. 1, 1977

[54] SAND CONSOLIDATION METHOD

[76] Inventor: Roy R. Vann, Box 38, Artesia, N. Mex. 88210

[22] Filed: Feb. 3, 1975

[21] Appl. No.: 546,802

[52] U.S. Cl. ..... 166/276; 166/286; 166/297; 175/4.56

[51] Int. Cl.[2] ..... E21B 43/116; E21B 43/26

[58] Field of Search ..... 166/55.1, 164, 276, 166/281, 285, 286, 291, 294, 297, 298; 175/4.57, 4.59, 4.56

[56] References Cited

UNITED STATES PATENTS

| | | | |
|---|---|---|---|
| 2,621,744 | 12/1952 | Toelke | 166/55.1 |
| 3,153,449 | 10/1964 | Lebourg | 166/286 |
| 3,170,517 | 2/1965 | Graham | 166/298 |
| 3,318,393 | 5/1967 | Brown | 166/286 |
| 3,348,621 | 10/1967 | Schuster | 166/286 |
| 3,361,204 | 1/1968 | Howard et al. | 166/55.1 |
| 3,433,305 | 3/1969 | Bell | 166/297 |
| 3,447,607 | 6/1969 | Harris et al. | 166/297 |
| 3,463,248 | 8/1969 | Bell | 166/55.1 |
| 3,593,797 | 7/1971 | Lebourg | 166/286 |
| 3,612,189 | 10/1971 | Brooks | 166/55.1 |
| 3,706,344 | 12/1972 | Vann | 166/297 |

*Primary Examiner*—Ernest R. Purser
*Attorney, Agent, or Firm*—Marcus L. Bates

[57] ABSTRACT

A method of completing a sandy production zone located downhole in a borehole by spotting a polymeric agent adjacent to the production zone, perforating the casing adjacent to the zone, and simultaneously increasing the pressure on the agent to a value which exceeds the formation pressure so that the polymeric agent is forced back up into the perforations as they are formed by the hot jets issuing from the gun.

The polymeric agent is allowed to "set up" into a porous self-supporting mass, the pressure on the agent is reduced, and the well produced with flow of the production occurring through the porous mass.

10 Claims, 14 Drawing Figures

SAND CONSOLIDATION METHOD

BACKGROUND OF THE INVENTION

There are many oil and water bearing formations which cannot be successfully produced because of the borehole becoming "sanded." That is, while producing the well, sand flows from the reservoir and into the production tubing, thereby eventually causing the flow rate to diminish and consequently significantly lowering the rate of production. Some formations of this type are uneconomical from a production standpoint because of the vast amount of technical attention required in producing the well after it has been completed.

It is old to employ a "sand screen" when encountering formations of this type. Moreover, sandy formations have heretofore been treated by pumping a polymeric material downhole into the production zone, letting the material "set," thereby providing a barrier to the sand and enabling improved production to be carried out. However, neither of these expedients have met with complete success in producing from highly sandy production zones.

It would be desirable to be able to place a porous agent within the production formation at the same time that the well is initially completed so that the reservoir is left undisturbed in its original configuration where it is protected against subsequent collapse which might occur if excessive unconsolidated sand is removed from downhole. Realization of such a desirable expedient would provide acceptable well production in sandy formations, and a savings in maintenance would be effected.

SUMMARY OF THE INVENTION

Generally the present invention relates to both a method and apparatus for completing a sandy formation which has been penetrated by a cased well bore. The invention is carried out by forcing a liquid plastic-like agent downhole into close proximity of the formation, and perforating the cased well bore while holding the agent under a pressure which exceeds the formation pressure. This expedient forces the agent into the perforations and back up into the formation prior to the occurrence of any production therefrom.

The agent is held under pressure until it hardens into a porous mass, whereupon a flow path is then established so that flow occurs from the formation, through the porous plastic material, into a production string, and uphole to the surface of the earth.

More specifically, the present invention is a method of treating and completing an unconsolidated sandy production formation located downhold in a well bore. The invention is carried out by lowering a tool string into the well bore wherein the tool string is a permanent completion apparatus and includes a large casing perforator means attached in underlying relationship respective to a packer means. A controlled flow path is formed through the tool string and extends downhole adjacent to the production formation. A perforated nipple can be included which is closed and has means associated therewith for opening the nipple perforations to flow.

The packer is set at a location which disposes the perforator gun means adjacent to the formation to be completed. An agent, comprised of a fluid polymeric material which hardens into a porous mass, is pumped downhole to the controlled flow path and to the same elevation of the formation where the agent is held within the tool string while the perforating means is actuated, whereupon the polymeric material is forced under pressure from the tool string and into the perforations formed within the formation. The agent hardens into a porous mass whereupon production flow then occurs from the formation, through the agent, into the tool string, and uphole to the surface of the ground.

Therefore, a primary object of this invention is the provision of improvements in completion of well bores having sandy production formations.

Another object of the invention is the provision of a method of completing a sandy formation located downhole in a borehole.

A further object of the invention is to provide a method of forcing a liquid agent back up into a sandy formation of a borehole, with the agent subsequently reacting to form a porous self-supporting mass.

Still a further object of the invention is the provision of both apparatus and method for consolidating a sandy formation located downhole in a borehole.

Another and still further object of the invention is to provide a method of permanently completing a borehole while at the same time treating a formation thereof in a manner to reduce problems associated with sand.

A still further object of the present invention is to provide a method of completing, treating, and producing a sandy formation of a borehole.

These and various other objects and advantages of the invention will become readily apparent to those skilled in the art upon reading the following detailed description and claims and by referring to the accompanying drawings.

The above objects are attained in accordance with the present invention by the provision of a method of treating sandy formations which can be carried out with apparatus fabricated in a manner substantially as described in the above abstract and summary.

DETAILED DESCRIPTION OF THE INVENTION

Figure 1:
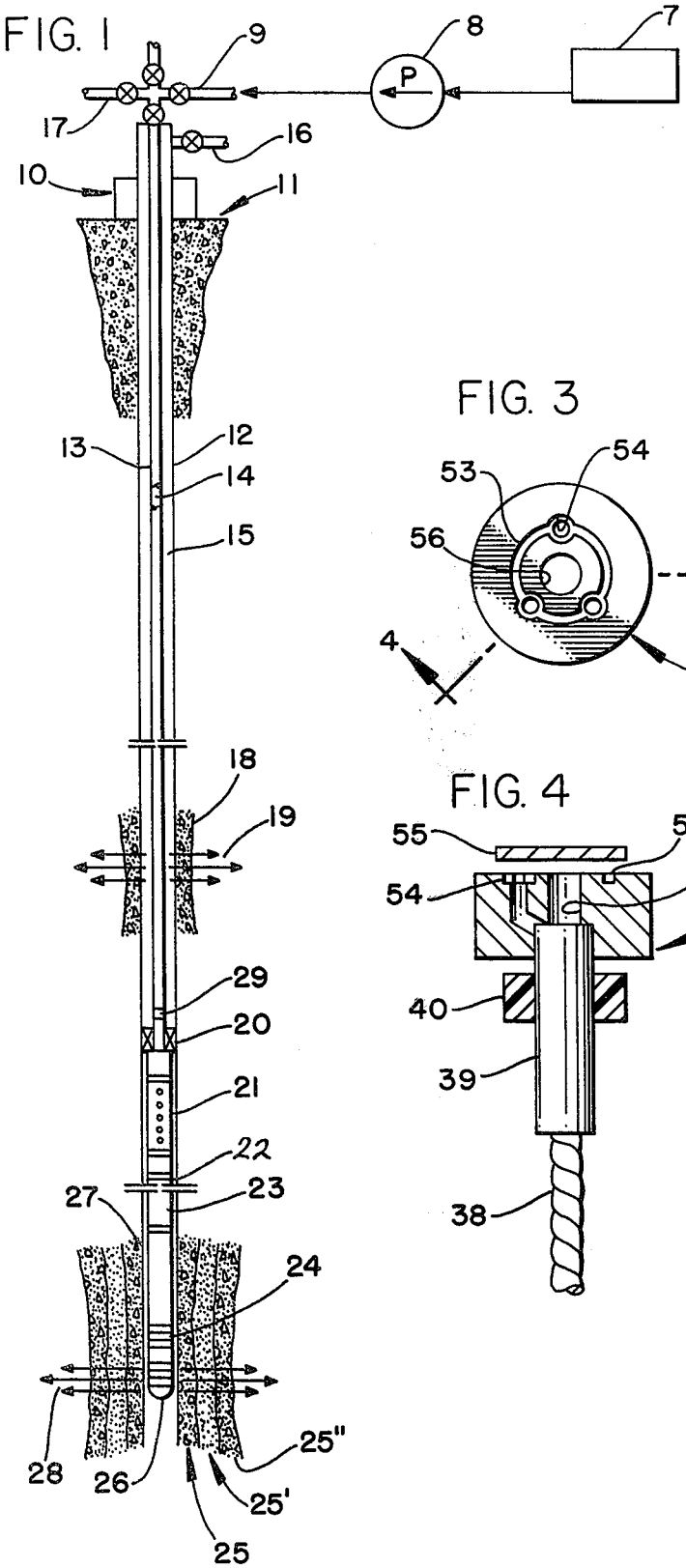
FIG. 1 is a part diagrammatical, part schematical illustration which discloses a method and apparatus, made in accordance with the present invention, operatively associated with a well bore.

In FIG. 1 there is disclosed a chemical containing reservoir 7 flow connected to a pump 8 which in turn is flow connected by means of a valve 9 to a well head 10. The well head is located above ground level 11 and is connected to a casing 12 in the usual manner. A production tubing 13 has an interior 14 and is concentrically arranged respective to the casing so that an annulus 15 is formed therebetween. The annulus is connected to the outflow line 16 while the production tubing is connected to the usual valve arrangement indicated by the numeral 17. Numeral 18 represents an upper production zone which has been perforated at 19.

The borehole annulus is separated into an upper and lower annulus by means of the packer apparatus 20, which can take on any number of different forms so long as the packer device accomplishes the purpose of the present invention. The production tubing can be of any length and may be connected to a wireline operated perforated nipple or vent string 21, which will remain in the closed position until it is moved into the opened or flow permitting position.

A releasable coupling 22 is interposed in the tubing and preferably is made in accordance with my copending U.S. patent application Ser. No. 517,391, filed Oct. 23, 1974. Tubing 23 suspends a jet perforating gun 24 therebelow so that the gun is located adjacent to a sandy production formation schematically illustrated by numerals 25, 25′, and 25″. The jet perforating gun has a lower end portion 26 and is positioned adjacent to the casing as seen at 27. The gun preferably is made in accordance with my previously issued U.S. Pat. No. 3,706,344, to which reference is made for any details thereof. Numeral 28 indicates the deep tunnels which are formed into the formation by means of the large casing type gun 24.

Where deemed desirable, a wireline actuated retrievable plug can be located in proximity of the packer as generally illustrated by the numeral 29. The retrievable plug preferably is made in accordance with my issued U.S. Pat. No. 3,812,911.

Figure 2:
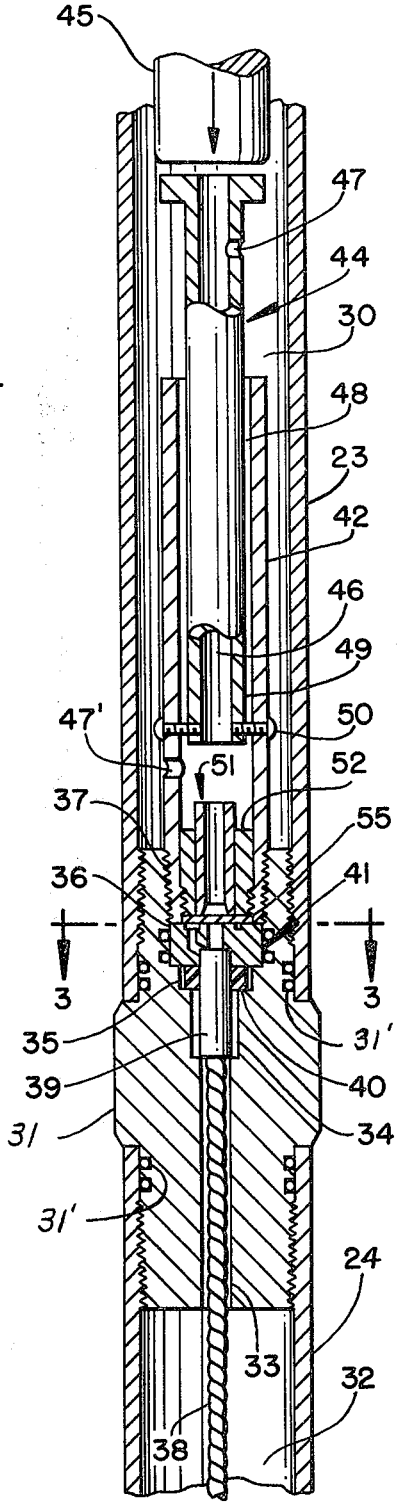
FIG. 2 is an enlarged, fragmentary, longitudinal, part cross-sectional representation of part of the apparatus disclosed in FIG. 1.

In FIG. 2, the before mentioned jet gun assembly is seen to have an upper end portion threadedly connected to the lower end of tubing 23, thereby forming an interior passageway 30 which is in communication with the valves at 9 and 17. Sub 31 of the gun assembly is provided with the illustrated threads so that the gun can threadedly engage the lower end of the tubing string in sealed relationship therewith.

An axial passageway extends from interior 32 of the gun, through the sub, and is comprised of a counterbore 33 which progressively enlarges at 34, 35, and 36, with a portion 37 thereof having a threaded surface formed thereon. Primer cord 38 is received within the counterbore 33 in attached relationship to a dynamite cap 39 in the usual manner. Resilient seal 40 seals the passageway against flow, while a cartridge holder 41 is received within the counterbore 36.

Upstanding cylinder 42 has a free end portion which slidably receives a hammer or shaft 44 in a reciprocating manner therethrough. A go-devil, in the form of weight 45, is seen about to impound upon the terminal end of the hammer.

The hammer is made hollow by means of an elongated passageway 46. Ports 47 and 47′, respectively, are formed in the hammer wall and the wall of the upstanding cylinder. Interface 48 is formed between the outer peripheral surface 49 of the hammer and the inner peripheral surface of the cylinder.

Figure 3:
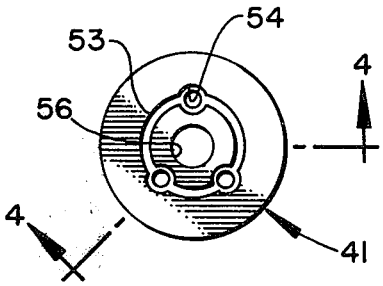
FIG. 3 is a view taken along line 3—3 of FIG. 2.
Figure 4:
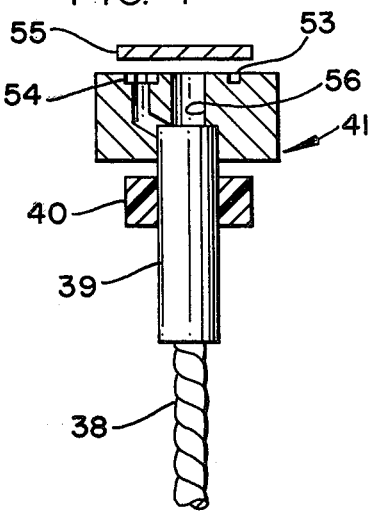
FIG. 4 is a cross-sectional view taken along line 4—4 of FIG. 3.

Shear pins 50 preferably are in the form of a common brass screw. A hollow firing pin 51, in the form of cylinder, is captured within holder 52. The cartridge holder is provided with a circumferentially extending groove or annular ring 53 which can receive the lower marginal end portion of a downwardly projecting skirt of the firing pin therein, as best seen in FIGS. 3 and 4. Equally spaced apart from one another and intersecting the groove are three drilled recesses 54, each of which receive a 22-caliber blank cartridge 54′ therein. A thin copper wafer 55 is compressed between the lower terminal end of the upstanding cylinder and the assembly 41, and acts as a gasket, thereby precluding fluid flow thereacross.

Axial passageway 56 is formed within the cartridge holder in aligned relationship with the passageway 56′ formed through the firing pin. Drilled counterbore 54 intersects counterbore 56. The lower marginal end of counterbore 56 receives a marginal free end portion of the beforementioned blasting cap therein in safe but close-fitting relationship.

Throughout the various figures of the drawings, wherever it is logical or practical to do so, like or similar elements will be referred to by like or similar numerals.

Figure 5:
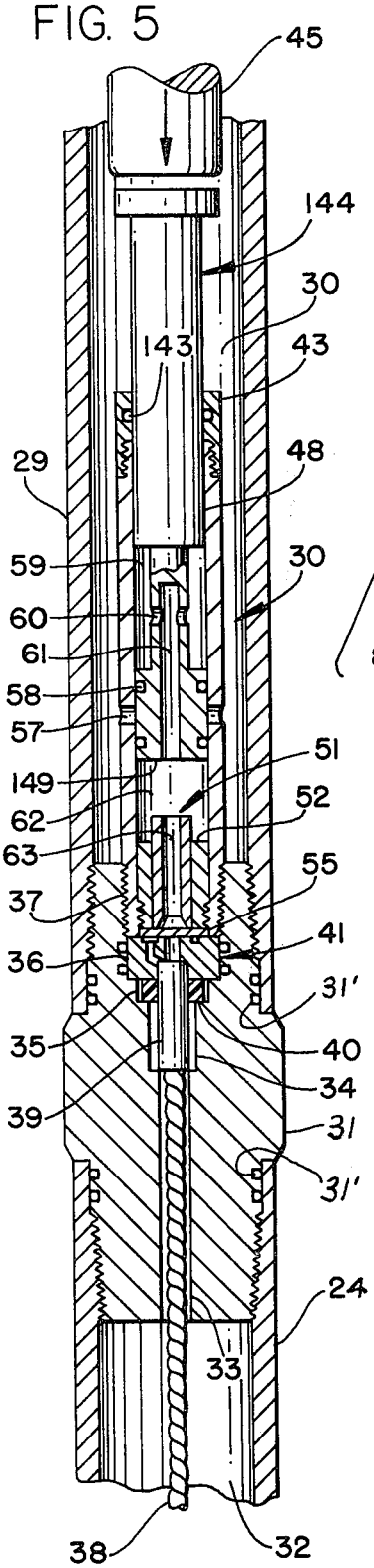
FIG. 5 is similar to FIG. 2 and discloses a modification of the invention.

In the embodiment disclosed in FIG. 5, radial ports 57 are formed through the side wall of the upstanding cylinder in sealed and aligned relationship respective to a piston 149. The piston is provided with spaced circumferentially extending O-rings 58 set in a conventional O-ring groove, with the O-rings being spaced on the piston in a position located on both sides of the radial ports.

A traveling annulus 59 provides part of a flow passageway as will be better understood later on in this disclosure. Radial ports 60 communicate counterbore 61 of the hammer with the traveling annulus 59. Working chamber 62 reciprocatingly receives piston 149 therein when the piston is moved. Firing pin 51 is provided with an axial passageway 63 formed therethrough.

Figure 6:
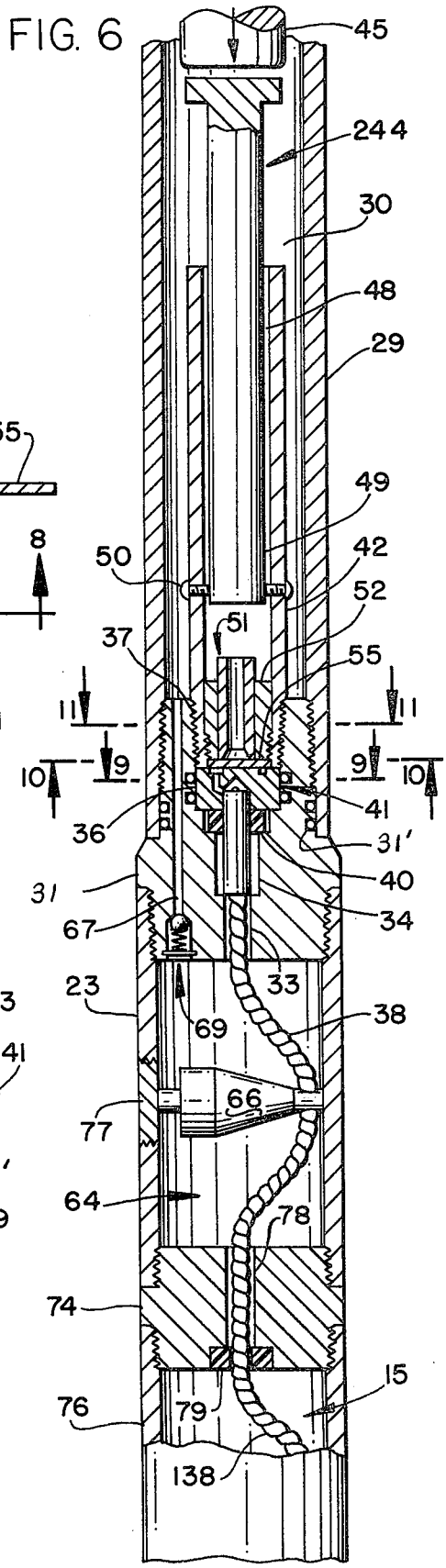
FIG. 6 is similar to FIGS. 2 and 5 and sets forth another modification of the invention.
Figure 9:
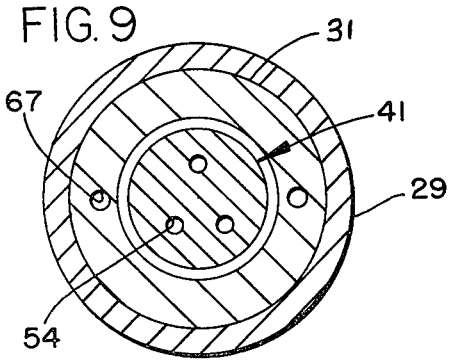
FIGS. 9–11, respectively, are cross-sectional views taken along lines 9—9, 10—10, and 11—11, respectively, of FIG. 6.
Figure 10:
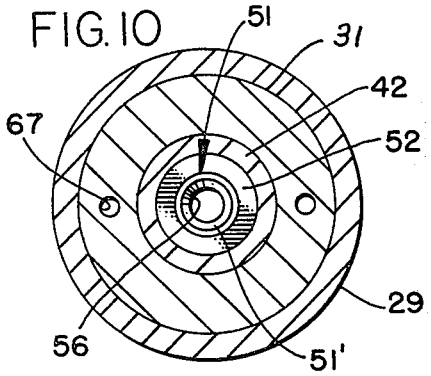
Figure 11:
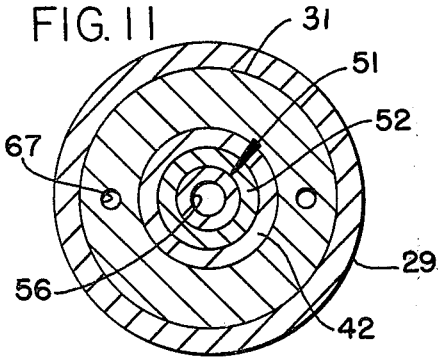

As seen in the illustration of FIG. 6, as well as other figures of the drawings, a charge carrying chamber 64 underlies the detonating head. A plurality of other charge carrying chambers 65 are arranged therebelow in the usual manner. A shaped charge 66 is mounted within its attendant chamber in any suitable manner with the prima cord being properly positioned relative thereto for causing the shaped charge to explode when the prima cord is detonated.

In the embodiment of FIG. 6, together with FIGS. 7–12, at least one chemical passageway 67 is radially spaced from the upstanding cylinder and provided with a counterbore 68 within which there is received a valve means in the form of a spring loaded valve assembly 69.

Figure 12:
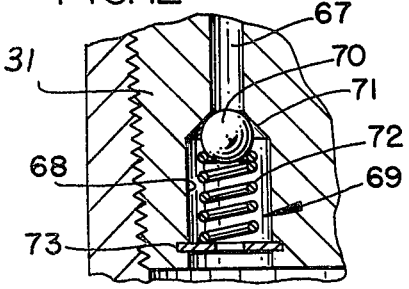
FIG. 12 is a fragmentary, longitudinal part cross-sectional representation of part of the apparatus disclosed in FIG. 6.

As best seen illustrated in FIG. 12, in conjunction with FIGS. 1 and 6, the valve assembly comprises a ball 70 suitably seated against a valve seat 71, with a compression spring 72 being interposed between a hollow keeper 73 and the ball, thereby forcing the ball check valve into a normally closed configuration.

Figure 7:
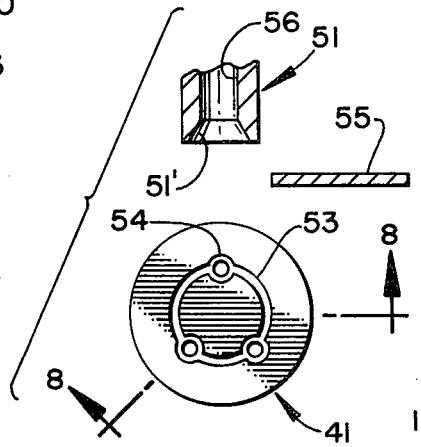
FIG. 7 is an exploded, part cross-sectional, partly broken view of some of the apparatus disclosed in FIGS. 2–5.
Figure 8:
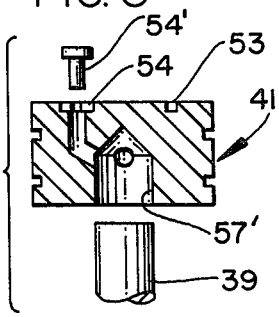
FIG. 8 is an enlarged, fragmentary, part cross-sectional view of part of the apparatus taken along line 8—8 of FIG. 7.

Looking again to the details of FIG. 6, in conjunction with FIGS. 7 and 12, sub 74 connects together adjacent spaced apart chamber forming components 75 and 76. Each of the chambers are provided with a window 77 aligned with the concave surface of the shaped charge so that the explosive blast from the charge is directed through the window and impinges against the casing wall. The window can be of conventional design.

Passageway 78 is optionally provided with a seal means 79 so that the prima cord can be connected from the blasting cap and through a sensitive portion of the shaped charges located in each of the underlying charge carrying chambers.

Figure 13:
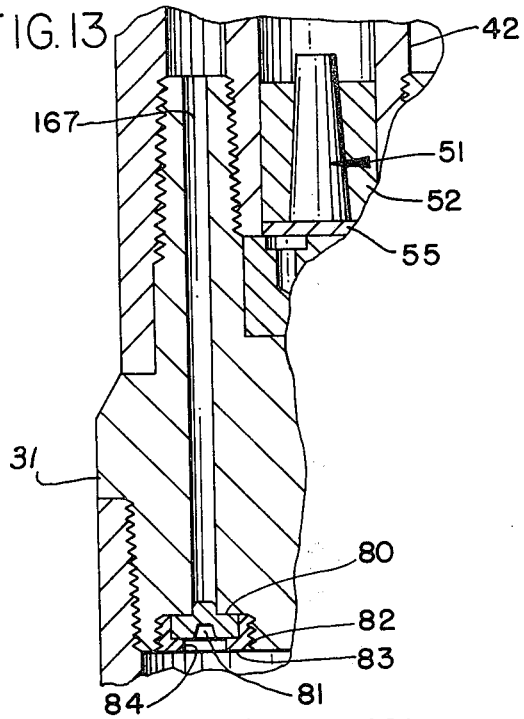
FIG. 13 is similar to FIG. 12 and sets forth still another modification thereof; and, FIG. 14 is a hypothetical, longitudinal, part cross-sectional view taken along the bottom of the borehole of FIG. 1.

Looking now to the details of FIG. 13, which sets forth a modification of the apparatus disclosed in FIGS. 6 and 12, there is disclosed a frangible plug 80 which has been weakened a predetermined amount by means of counterbore 81; thereby causing the plug to disintegrate when subjected to a predetermined pressure drop thereacross. Plug holder 82 threadedly engages the detonator sub and is provided with an inwardly directed shoulder 83 which terminates at edge portion 84.

Figure 14:
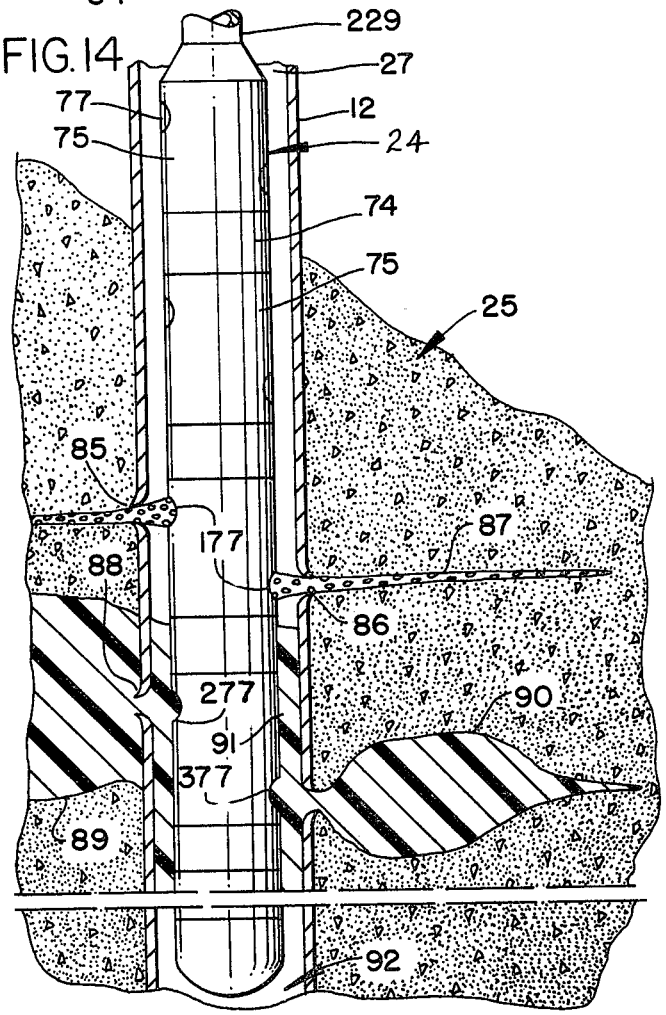

In the hypothetical illustration of FIG. 14, the beforementioned casing is seen to be in the act of being perforated at 85 and 86 by means of the hot jet of explosive gases directed from ruptured windows 177. The casing perforator is reaching far back up into the formation 25, with the formation being illustrated as an unconsolidated sandy type of structure.

Perforations 88 illustrate the downhole configuration of the apparatus several seconds after the gun has been detonated. In particular, it is seen that plastic foam 89 has been forced from window 277, through the casing perforations 88, and back up into the formation. In a similar manner, foam plastic at 91 fills a marginal length of the annulus between the gun and the casing, and is being forced from the perforated windows 377 and back up into the formation at 89 and 90. Numeral 92 indicates the lowermost elevation of the treatment zone, which has previously been filled with clean water.

OPERATION

In carrying out the method of the present invention, a jet perforating gun, such as illustrated in FIGS. 2–13, is run downhole along with various other well bore equipment, as exemplified by the diagrammatical illustration of FIG. 1. The production zone 25 is comprised primarily of unconsolidated sand, which ordinarily upon completion of the well, flows into the bottom of the borehole and eventually "sands in" the well. Accordingly, the present invention provides a means by which porous plastic foam can be located back up within the formation, so that production from the hydrocarbon bearing zone flows through the plastic foam and into the well bore. Accordingly, the unconsolidated sand is undisturbed and production can be carried out for many years without injury to the production zone.

In order to prevent any significant damage to the sandy structure of the formation, it is desirable that the material from which the plastic is formed be forced back up into the formation immediately upon perforation of the formation. This expedient prevents foreign material, other than the inert plastic foam, from contaminating the production zone as well as collapse of the penetrated formation.

The permanent completion apparatus is assembled in the manner of FIG. 1 with the packer 20 being set, and with the perforated nipple in the closed configuration. After the chemical tank and pump are suitably connected to the well head, a wireline fishing tool is run downhole and the retrievable plug 29 removed, thereby providing an unrestricted passageway from the hammer 44 of the detonator to the lubricator associated with the well head. It is usually desirable to have the lower borehole annulus filled with clean water.

A foamable two part chemical mixture, usually comprised of a polymeric material or resin, together with a catalyst and a foaming agent, is spotted downhole within the lower extremity of the tubing at a location above sub 22, so that the area 30 contains the unreacted chemicals. The gun must be detonated before the liquid plastic material sets up.

Various different chemicals are contemplated by the term "foamable agent" as used herein, including organic agents such as diisocyanates (toluene di-isocyanate) admixed with propylene glycol and 1½ percent water; as well as inorganic agents such as silicon flouride gas which reacts with downhole water and sand to form silica gel, for example. There are other polymeric materials known to those skilled in the art which can be used to advantage by following the teachings of the present invention.

In the embodiment disclosed in FIG. 2, the go-devil strikes the hammer, whereupon the pins are sheared; thereby forcing the hammer into abutting engagement with the firing pin. This action causes the firing pin to cut through the wafer 55, thereby exploding the blank cartridges. Energy resulting from the detonation of the cartridges explodes the blasting cap 39, which in turn causes explosion of the prima cord attached thereto. The prima cord in turn sequentially detonates each of the shaped charges, which in turn perforates the casing as well as the formation lying outwardly therefrom.

Detonation of the blasting cap and cord disintegrates both the cap and the wafer; thereby providing an unobstructed passageway which extends from interior 30 of the tubing, into the hollow hammer, through the hollow firing pin, through the passageways 56, 35, 34, and 33 so that the polymeric material located at 30 can be forced along the flow path and into each of the charge containing chambers, whereupon the polymeric material can then flow through the ruptured windows and into the annulus formed between the gun and the casing.

As water, or other fluid, including inert gases, is pumped into the tubing string, the plastic material is forced through the casing perforations and back up into the formation in the manner of FIG. 14. Pressure is maintained on the tubing interior until the plastic material sets up.

In the embodiment of FIG. 5, the go-devil forces piston 149 of the hammer 144 to move into abutting relationship with the firing pin, whereupon the beforementioned sequence of events occurs. In this instance, flow of plastic material occurs from annulus 30, through port 57, into the traveling annulus 59, through port 60 into the hammer counterbore 61, through the hollow firing pin, through bore 34, into the various series connected charge carrying chambers, where the flow branches and flows through the ruptured windows of each chamber.

In the embodiment of FIGS. 6 and 12, fluid flow occurs through the chemical passageways 67; through the valve assembly 69, and into each of the charge carrying chambers.

Where a frangible plug 80 is employed in the manner of the illustrated embodiment of FIG. 13, the plug is destroyed by the explosive pressures caused by detonation of the shaped charge along with the primer cord; thereby providing an unobstructed passageway for the flow of polymeric material into each of the gun chambers.

I claim:

1. Method of completing an unconsolidated production formation which is located downhole in a borehole comprising the steps of:

1. suspending a perforating gun adjacent to the formation by connecting the gun to a tubing string and running the tubing string downhole;
2. locating a foamable agent in the tubing string downhold adjacent to the gun; said agent initially being in a fluid state and having properties which cause it to undergo chemical reaction over an interval of time to form a self-supporting porous mass;
3. forming a flow path which extends from the interior of the tubing string, through at least part of the gun, and into the borehole annulus located between the borehole wall and the gun;
4. communicating the borehole with the formation by perforating the borehole wall with the gun;
5. forcing said agent to flow from the tubing string and into the formation by increasing the pressure on said agent to a value which exceeds the formation pressure, while the agent is in a fluid state;
6. holding the pressure on said agent at a value which is at least equal to the formation pressure until an inverval of time expires during which the agent undergoes chemical reaction and becomes a self-supporting porous mass;
7. reducing the pressure of step (6) so that formation fluid flows through the self-supporting porous mass and into the production tubing.

2. The method of claim 1, and further including the following steps:

8. isolating an upper marginal length and a lower marginal length of the borehole annulus from one another by interposing a packer in the tubing string and setting the packer so that fluid flow from the formation is forced to flow into the tubing string.

3. The method of claim 2, and further including the step of:

9. forming a flow path from the perforated borehole wall into the tubing string by interposing a perforated nipple between the packer and the gun so that at least part of the fluid from the formation is forced to flow up the lower marginal length of the borehole annulus, into the perforated nipple, and up the tubing string.

4. The method of claim 3 wherein the perforated nipple is closed until after step (6) has been carried out, and wherein the perforated nipple is moved to the opened position to thereby enable step (9) to be carried out.

5. The method of claim 1 wherein said foamable agent includes a polymeric material.

6. The method of claim 1 wherein said foamable agent is a di-isocyanate admixed with propylene glycol and water.

7. The method of claim 1 and further including the steps of:

8. carrying out step (3) according to the following steps:
   - 3a. forming an obstruction in said flow path which normally precludes fluid flow therethrough;
   - 3b. arranging an explosive device in proximity to said obstruction;
   - 3c. detonating said explosive device; and,
   - 3d. using the energy of step (3c) for removing the obstruction of step (3a).

8. Apparatus for completing an unconsolidated formation of a cased borehole comprising a tool string which includes perforation gun, a tubing string, a packer means; means by which said gun is supported from said tubing string in underlying relationship respective to said packer means;

means by which said packer and said tubing string are connected together such that a borehole annulus is formed between the tool string and the wall of the cased borehole is divided into an upper and a lower borehole annulus;

said gun having an explosive charge carrying chamber, a detonator means for remote actuation; and, means forming an obstructed flow path from the interior of the tubing string into said chamber;

means associated with said detonator means for rendering said obstructed flow path free for fluid flow therethrough in response to actuation of said detonator means;

means above said gun and within said tubing string for containing a foamable agent therewithin so that said gun can be positioned adjacent to the formation to be completed, a foamable agent placed above said gun and within said tubing string, and the agent pumped along said flow path and into the formation after the gun has been detonated.

9. The apparatus of claim 8 wherein said detonator means includes a firing head; means mounting a detonator holder, a firing pin, and a hammer within said head; said holder, firing pin, and hammer being concentrically arranged in superimposed relationship respective to one another so that when said hammer is moved against said firing pin, said detonator is exploded;

means forming said obstructed passageway through said hammer, firing pin, and detonator holder.

10. The apparatus of claim 9 wherein said obstruction is a wafer placed between said firing pin and said detonator holder so that said firing pin can engage and perforate said wafer, thereby rendering said obstructed passageway unobstructed.

* * * * *